United States Patent [19]

Gordos

[11] 4,008,896

[45] Feb. 22, 1977

[54] WEIGHT ADJUSTOR ASSEMBLY

[76] Inventor: Ambrose L. Gordos, 4301 E. 2nd, No. 1E, Long Beach, Calif. 90803

[22] Filed: July 10, 1975

[21] Appl. No.: 594,635

[52] U.S. Cl. ..... 273/171

[51] Int. Cl.[2] ..... A63B 53/04

[58] Field of Search ..... 273/32 R, 32 A, 32 D, 273/77 R, 162 R, 167 R, 167 F, 171, 172, 81 A, 73 J, 174; 224/5 C, 5 D, 21, 26 R; 221/64, 69, 307–310

[56] References Cited

UNITED STATES PATENTS

| | | | |
|---|---|---|---|
| 1,133,129 | 3/1915 | Govan | 273/171 |
| 1,167,387 | 1/1916 | Daniel | 273/171 |
| 1,453,503 | 5/1923 | Holmes | 273/171 |
| 2,332,342 | 10/1943 | Reach | 273/171 |
| 2,782,035 | 2/1957 | East | 273/81 A |
| 2,998,254 | 8/1961 | Rains et al. | 273/171 |
| 3,061,310 | 10/1962 | Giza | 273/171 X |
| 3,466,047 | 9/1969 | Rodia et al. | 273/171 |
| 3,529,825 | 9/1970 | White | 273/174 X |
| 3,652,094 | 3/1972 | Glover | 273/171 |
| 3,680,868 | 8/1972 | Jacob | 273/174 |

FOREIGN PATENTS OR APPLICATIONS

| | | | |
|---|---|---|---|
| 844,455 | 6/1960 | Canada | 273/171 |
| 174,550 | 2/1922 | United Kingdom | 273/73 J |
| 194,823 | 3/1923 | United Kingdom | 273/171 |
| 347,502 | 4/1931 | United Kingdom | 273/171 |

*Primary Examiner*—Richard J. Apley
*Attorney, Agent, or Firm*—William C. Babcock

[57] ABSTRACT

A golf club head weight adjustor assembly that includes an elongate tube of a resilient material that has first and second ends, and the tube capable of being removably disposed in an elongate cavity in the club head that is substantially parallel to the ball striking surface of the head. The tube has first radial openings adjacent the ends thereof. A number of longitudinally spaced, radial, second openings are defined in the tube that are transversely aligned with third radial openings. Rigid weight balls, each of a fourth diameter greater than that of the second openings, can be forced radially through the second opening into the bore of the tube to be frictionally gripped by the latter and occupy a fixed longitudinal position therein. A closure removably engages the head to close the cavity to maintain the weight adjuster within the confines of the latter. A tool is included as a part of the assembly, which tool has a pin and hook formed as an integral part thereof. The hook may removably engage one of the first openings to slidably remove a tube and weighted ball contained therein from the club head. The pin of the tool may be moved radially through the third openings to force unwanted weight balls from within the confines of the tube through the second openings to the exterior thereof.

3 Claims, 7 Drawing Figures

FIG.1
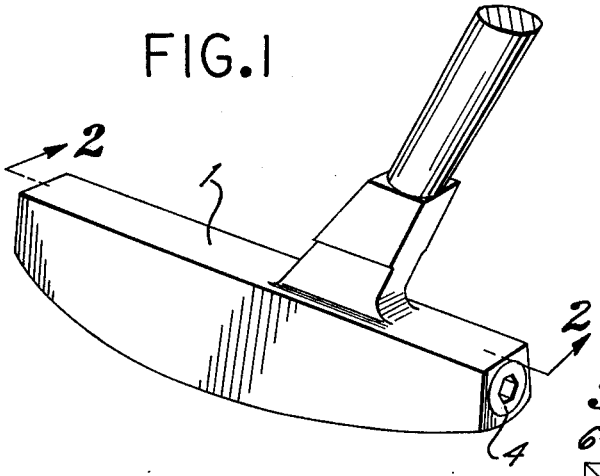
FIG.2
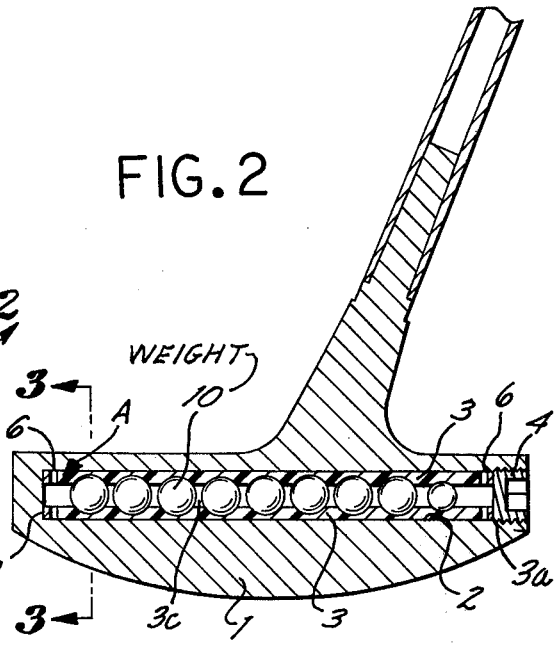
FIG.3
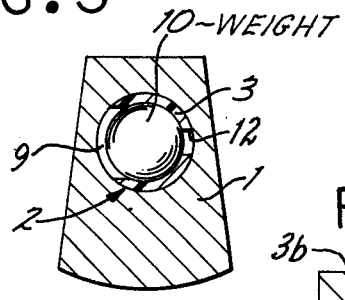
FIG.4
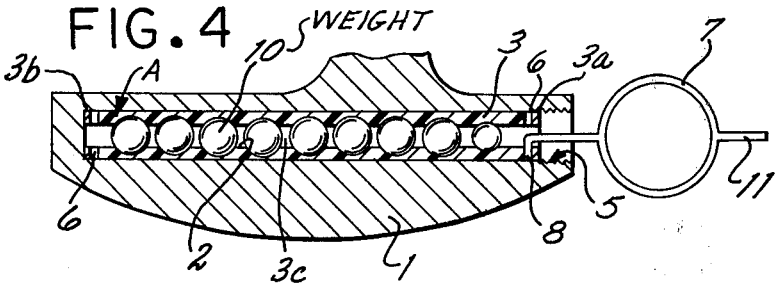
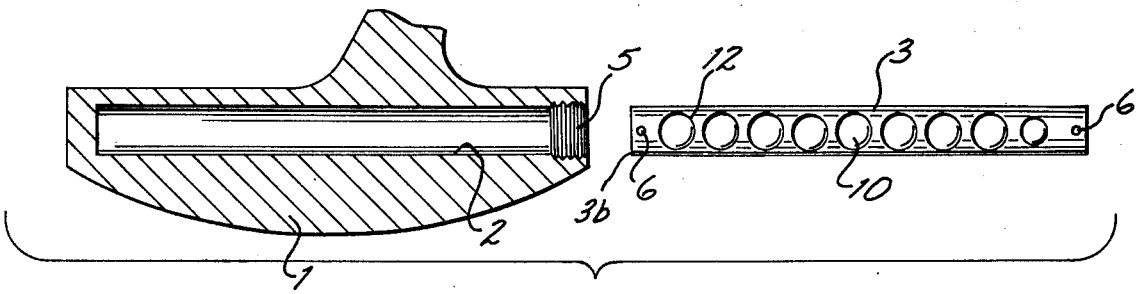
FIG.5
FIG.6
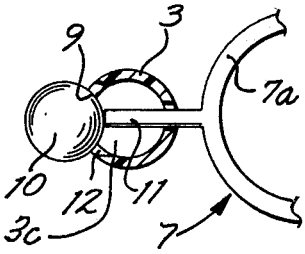
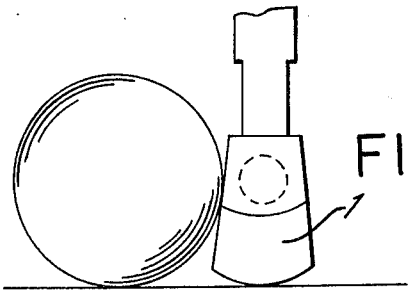
FIG.7

WEIGHT ADJUSTOR ASSEMBLY

BACKGROUND OF THE INVENTION

1. Field of the Invention

Weight adjustor assembly.

2. Description of the Prior Art

In golf clubs, the weight of the head and the balance thereof is a most important factor. Such weight and balance must be adjusted to the individual player, if the player is to use the club to maximum advantage. Golf club heads, have in the past, had elongate cavities formed therein which in combination with closures defined confined spaces in which weight may be disposed.

In adjusting a golf club had to a particular player, weight must be placed in and removed from the confined space above described. As weights are added to or removed from the confined space it is essential that the remaining weights in the confined spaced by maintained in a fixed spaced relationship to maintain a proper weight balance in the head.

The primary purpose in devising the present invention is to supply a weight adjustor assembly that has a portion thereof that is removably disposed in an elongate cavity in the club head parallel to the striking face of the club, with the adjustor when removed from the head capable of having weights added to or removed therefrom without disturbing the spaced relationship of the weights remaining in place on the adjustor, and the adjustor when replaced in the cavity not only providing a desired weight but a weight that is distributed on the had to suit a particular individual player.

Another object of the invention is to furnish a weight adjustor assembly that includes a tool as a part thereof that permits the portion of the weight adjustor in the cavity to be easily retreived therefrom, and to permit desired individual weights held in this portion of the adjustor to be removed therefrom without disturbing the balance of the weight situated in this portion of the weight adjustor.

SUMMARY OF THE INVENTION

The weight adjustor assembly is for use on a golf club head that has an elongate cavity that is substantially parallel to the striking surface of the head and a closure that removably engages the free end of the cavity. The weight adjustor assembly includes an elongate tube formed from a resilient material, with the tube of such length and external diameter as to fit snuggly within the cavity when the latter is closed by the closure. The tube has a longitudinal bore of a first diameter therein, with the tube having first and second ends, at least one radial first opening adjacent the first end of the tube, a number of longitudinally spaced second radial openings of a second diameter, and the second openings being of lesser diameter than the first diameter. A number of third radial openings are formed in the tube that are transversely aligned with the second openings, and the first and thrid openings being a substantially lesser diameter than the second diameter.

A number of rigid weight balls are provided, with each of the balls of a thrid diameter that is greater than the first diameter. The weight balls are capable of being forced radially and inwardly through the second openings into the bore of the tube to be frictionally gripped by the resilient tube and occupy a fixed longitudinal position therein. The assembly includes a tool that has a handle, an elongate pin secured to the handle, and a hook that is also secured to the handle, with the hook when the closure is removed from the club head capable of engaging the first opening to permit the weight adjustor to be withdrawn from the cavity. After the weight adjustor has been withdrawn from the cavity the pin may be moved radially through a desired one of the third openings to force an unwanted one of the weights outwardly through the second opening most adjacent thereto. The weight adjustor assembly preferably has the tube portion thereof formed from a polymerized resin.

BRIEF DESCRIPTION OF THE DRAWING

FIG. 1 is a perspective view of a golf club head adapted to have the weight adjustor removably mounted within the confines thereof;

FIG. 2 is a vertical cross sectional view of the golf club head taken on the line 2—2 of FIG. 1 and illustrating the weight adjustor in position within the confines of the head;

FIG. 3 is a transverse cross sectional view of the golf club head and weight adjustor taken on the line 3—3 of FIG. 2;

FIG. 4 is a fragmentary transverse cross sectional view of a portion of the golf club and illustrating the weight adjustor and tool in a position where the weight adjustor may be withdrawn from the club head;

FIG. 5 is the same view as shown in FIG. 4 but with the weight adjustor withdrawn from the cavity formed in the club head;

FIG. 6 is a transverse cross sectional view of the weight adjustor with the prong of a tool being moved through one of a number of transverse openings formed in the weight adjustor to displace a desired weight ball from the latter; and FIG. 7 is an end elevational view of the weighted club head just prior to contacting a golf ball.

DESCRIPTION OF THE PREFERRED EMBODIMENT

The complete weight adjustor assembly A is shown in FIG. 4 and is adapted to be used with a golf club head 1 that has an elongate cavity 2 therein that is substantially parallel to the ball striking face of the head. A set screw 4 is adapted to engage internal threads 5 formed on the club head 1, with the set screw and cavity 2 cooperating to define an elongate confined space in which a part of the weight adjustor assembly A may be removably disposed.

Weight adjustor assembly A includes an elongate tube 3 that is formed from an elastomer, such as a commercially available polymerized resin. Tube 3 has first and second ends 3a and 3b and is of such transverse cross section and length as to fit snuggly within the bore *3c* of the tube 3. A pair of first radial openings 6 are formed in tube 3 adjacent the first and second ends *3a* and *3b* thereof. A number of longitudinally spaced, second openings 9 are formed in tube 3 and are of a diameter that is less than the diameter of the bore *3c* in the tube 3. The tube 3 has a number of longitudinally spaced third openings 12 therein that are diametrically aligned with second openings 9 but are of less diameter than the latter. The weight adjustor assembly A includes a number of weight balls 10. Each weight ball 10 is slightly greater in diameter than the bore diameter. Each weight ball 10 can be forced radially through one of the second openings 9 into the interior of the tube 3 to be frictionally gripped by the tube and removably held in a fixed longitudinal position therein. Each weight ball 10 when disposed within tube 3 has a portion of the ball projecting into the second opening 9 most adjacent thereto.

After the tube 3 has the desired number of weight balls 10 disposed therein, the tube and balls are inserted as a unit into the cavity 2 and set screw 4 is rotated into engagement with threads 5. A tool 7 is provided as a part of assembly A. The tool 7 as may be seen in FIG. 4 includes a ring 7a that has a hook 8 and pin 11 projecting outwardly therefrom.

When it is desired to change the weight of the golf club had 1, the set screw 4 is rotated out of engagement with threads 5, and the hook 8 of tool 7 is caused to engage one of the first openings 6 as may be seen in FIG. 4, with the tool 7 then being moved outwardly relative to club 1 to withdraw the tube 3 therefrom. Any one of the weight balls 10 can be removed from the tube 3 by the pin 11 being extended through one of the third openings 12 to force a desired ball 10 outwardly through the opening 9 most adjacent thereto. After the desired number of balls 10 have been removed from tube 3 or balls 10 added thereto, the tube is inserted in the cavity 2, and the set screw 4 is caused to engage threads 5 to hold the weight adjustor A within the cavity 2 as shown in FIG. 2.

The use and operation of the invention has been explained previously in detail and need not be repeated.

I claim:

1. A weight adjuster assembly for use on a golf club head having an elongate cavity therein that is substantially parallel to the striking surface of said head and a closure that removably engages the free end of said cavity, said weight adjuster assembly including:

a. an elongate tube of a resilient material of such length and external diameter as to fit snugly within said cavity when the latter is closed by said closure, said tube having a longitudinal bore of a first diameter therein, said tube having first and second ends, at least one radial first opening adjacent said first end of said tube, a plurality of longitudinally spaced second radial openings of a second diameter in said tube, and a plurality of third radial openings of a third diameter in said tube that are transversely aligned with said second openings;

b. a plurality of rigid weight balls, each of said balls of a fourth diameter that is greater than said first and second diameters, and said weight balls capable of being forced inwardly through said second openings into said bore to be frictionally gripped by said resilient tube to occupy a fixed longitudinal position therein; and c. a tool that includes a curved member, an elongate pin secured to said curved member, said hook when said closure is removed from said head capable of engaging said first opening to permit said weight adjuster to be withdrawn from said cavity, and said pin after said weight adjuster is removed from said cavity capable of being moved radially through said third openings to force unwanted of said weight balls from said bore outwardly through said second openings.

2. A weight adjuster assembly as defined in claim 1 in which said tube is formed from a polymerized resin.

3. A weight adjuster assembly as defined in claim 1 which also includes a first radial opening adjacent said second end of said tube.

* * * * *